US008029966B2

(12) United States Patent
Kamiyoshi

(10) Patent No.: US 8,029,966 B2
(45) Date of Patent: Oct. 4, 2011

(54) RELEASING AGENT DISPERSION

(75) Inventor: Nobumichi Kamiyoshi, Wakayama (JP)

(73) Assignee: Kao Corporation, Tokyo (JP)

( * ) Notice: Subject to any disclaimer, the term of this patent is extended or adjusted under 35 U.S.C. 154(b) by 971 days.

(21) Appl. No.: 11/829,558

(22) Filed: Jul. 27, 2007

(65) Prior Publication Data

US 2008/0026312 A1 Jan. 31, 2008

(30) Foreign Application Priority Data

Jul. 31, 2006 (JP) ..... 2006-208491

(51) Int. Cl.
*G03G 5/00* (2006.01)

(52) U.S. Cl. ..... 430/137.1; 430/108.4

(58) Field of Classification Search ..... 430/137.1, 430/108.4
See application file for complete search history.

(56) References Cited

U.S. PATENT DOCUMENTS

| | | | | |
|---|---|---|---|---|
| 6,074,796 | A * | 6/2000 | Matsuoka et al. | 430/137.1 |
| 2003/0027066 | A1 | 2/2003 | Yamashita et al. | |
| 2005/0026056 | A1 * | 2/2005 | Fujikawa et al. | 430/45 |

FOREIGN PATENT DOCUMENTS

| | | |
|---|---|---|
| DE | 102 16 507 A1 | 10/2003 |
| JP | 60-14932 | 1/1985 |
| JP | 11-2922 | 1/1999 |
| JP | 2002-296839 | 10/2002 |
| JP | 2004-271686 | 9/2004 |

OTHER PUBLICATIONS

Chinese Office Action issued Mar. 11, 2011, in Patent Application No. 200710139753.0 (with English-language translation).

* cited by examiner

*Primary Examiner* — Mark Chapman
(74) *Attorney, Agent, or Firm* — Oblon, Spivak, McClelland, Maier & Neustadt, L.L.P.

(57) ABSTRACT

The present invention relates to a releasing agent dispersion for toner including a releasing agent, and a dibasic acid containing an alkyl group and/or an alkenyl group or a salt of the dibasic acid, wherein at least one acid group of the dibasic acid is a carboxyl group; and a toner for electrophotography which is produced by aggregating and unifying releasing agent particles and resin particles contained in a dispersion produced by mixing or contacting the releasing agent dispersion with a resin dispersion. The releasing agent dispersion for toner according to the present invention has a good emulsifiability and a good emulsification stability, and is capable of producing a toner which is excellent in productivity and low-temperature fixing property.

30 Claims, No Drawings

RELEASING AGENT DISPERSION

FIELD OF THE INVENTION

The present invention relates to a releasing agent dispersion for toner and a process for producing the releasing agent dispersion, as well as a toner for electrophotography obtained by using the releasing agent dispersion and a process for producing the toner.

BACKGROUND OF THE INVENTION

In the field of toners for electrophotography, with the progress of electrophotographic systems, it has been demanded to develop toners adaptable for high image quality and high copying speed. From the viewpoint of the high image quality, the toners have been required to have a small particle size. Thus, there is disclosed a so-called chemical toner obtained by a chemical method such as a polymerization method and an emulsification and dispersion method in place of the conventional melt-kneading method (refer to JP 2004-271686A and JP 2002-296839A). Further, from the viewpoint of the high copying speed, there has been reported a chemical toner to which a releasing agent is added as an internal additive in order to improve a low-temperature fixing property thereof (refer to JP 11-2922A).

On the other hand, JP 60-14932A discloses a wax dispersion suitably used in the chemical method.

SUMMARY OF THE INVENTION

Thus, the present invention relates to:

(1) A releasing agent dispersion for toner including a releasing agent, and a dibasic acid containing at least one selected from the group consisting of an alkyl group and an alkenyl group or a salt of the dibasic acid, wherein at least one acid group of the dibasic acid is a carboxyl group;

(2) a process for producing a releasing agent dispersion, including the step of dispersing a releasing agent in an aqueous medium in the presence of a dibasic acid containing at least one selected from the group consisting of an alkyl group and an alkenyl group at least one acid group of which is a carboxyl group, or a salt of the dibasic acid while heating at a temperature not lower than a melting point of the releasing agent;

(3) a toner for electrophotography which is produced by aggregating and unifying releasing agent particles and resin particles contained in a dispersion produced by mixing or contacting the releasing agent dispersion as defined in the above aspect (1) with a resin dispersion; and (4) a process for producing a toner for electrophotography including the steps of (A) aggregating releasing agent particles and resin particles contained in a dispersion produced by mixing or contacting the releasing agent dispersion as defined in the above aspect (1) with a resin dispersion; and (B) unifying the aggregated particles obtained in the step (A).

DETAILED DESCRIPTION OF THE INVENTION

In the process for producing a toner by a chemical method, in particular, by an emulsification and dispersion method, a mechanical shear force tends to be inapplicable to the dispersion during the production process unlike those processes using a melt-kneading method. Therefore, it is difficult to disperse a releasing agent in the toner by the conventional chemical method. Further, the conventional chemical method still fails to sufficiently meet a recent demand for high copying speed and high image quality.

The present invention relates to a releasing agent dispersion for toner having a good emulsifiability and a good emulsification stability and being capable of producing a toner which is excellent in productivity, durability and low-temperature fixing property, and a process for producing the releasing agent dispersion, as well as a toner for electrophotography obtained by using the releasing agent dispersion, and a process for producing the toner.

[Releasing Agent Dispersion for Toner]

The releasing agent dispersion for toner according to the present invention is described.

The releasing agent dispersion for toner according to the present invention is a dispersion composed of a releasing agent, and a dibasic acid containing an alkyl group and/or an alkenyl group or a salt of the dibasic acid, wherein at least one acid group of the dibasic acid is a carboxyl group.

When using the conventional monobasic acid salt (soap) such as monocarboxylic acid salts as an emulsifier, in order to attain an emulsion of a releasing agent, a large amount of the releasing agent must be added thereto. As a result, the resultant toner tends to be deteriorated in durability. Also, when using a tri- or higher basic acid salt as the emulsifier, it is difficult to emulsify the releasing agent even though a large amount of the tri- or higher-basic acid salt is added thereto.

On the other hand, when using the dibasic acid containing an alkyl group and/or an alkenyl group or a salt of the dibasic acid as the emulsifier, the releasing agent can be emulsified even upon adding a small amount of the dibasic acid or the salt thereof.

The alkyl group contained in the dibasic acid containing an alkyl group and/or an alkenyl group or the salt thereof used in the present invention may be a linear, branched or cyclic alkyl group having preferably 8 to 22 carbon atoms and more preferably 12 to 20 carbon atoms. Examples of the alkyl group include various octyl groups, various decyl groups, various dodecyl groups, various tetradecyl groups, various hexadecyl groups, various octadecyl groups and various icosyl groups.

The alkenyl group contained in the dibasic acid containing an alkyl group and/or an alkenyl group or the salt thereof used in the present invention may be a linear, branched or cyclic alkenyl group having preferably 8 to 22 carbon atoms and more preferably 12 to 20 carbon atoms. Examples of the alkenyl group include various octenyl groups, various decenyl groups, various dodecenyl groups, various tetradecenyl groups, various hexadecenyl groups, various octadecenyl groups and various icosenyl groups. Meanwhile, the term "various groups" mean all of linear, branched and cyclic groups.

From the viewpoint of a good aggregating property of the dispersion, at least one acid group of the dibasic acid is a carboxyl group. Also, examples of the other acid group of the dibasic acid include a carboxyl group or a sulfonic group. Among these groups as the other acid group, from the viewpoint of a good aggregating property of the releasing agent dispersion, preferred is a carboxyl group. Therefore, from the viewpoints of a good emulsifiability, a good emulsification stability and a good aggregating property, among these dibasic acids, preferred are those dibasic acids containing an alkyl group and/or an alkenyl group each having 8 to 22 carbon atoms, one acid group of which is a carboxyl group and the other acid group of which is a carboxyl group or a sulfonic group; more preferred are dicarboxylic acids containing an alkyl group and/or an alkenyl group each having 8 to 22 carbon atoms; and even more preferred are dicarboxylic acid containing an alkyl group and/or an alkenyl group each having 12 to 20 carbon atoms.

Examples of the salt of the dibasic acid include alkali metal salts such as sodium salts and potassium salts.

Specific examples of the salt of the dibasic acid include disodium monoalkylsuccinate sulfonates, disodium alkylsuccinates, dipotassium alkylsuccinates, disodium alkenylsuccinates and dipotassium alkenylsuccinates. The alkyl group and/or alkenyl group preferably has 8 to 22 carbon atoms and more preferably 10 to 20 carbon atoms. Among these dibasic acid salts, preferred are dipotassium alkenylsuccinates having 12 to 20 carbon atoms from the viewpoints of a good emulsifiability, a good storage stability and a good aggregating property.

In the present invention, these dibasic acids or the salts thereof may be used alone or in combination of any two or more thereof.

Form the viewpoints of a good emulsification stability and a good aggregating property, the releasing agent dispersion for toner according to the present invention contains the dibasic acid or the salt thereof in an amount of preferably from 0.1 to 5% by weight and more preferably from 0.1 to 4% by weight.

In the releasing agent dispersion of the present invention, in addition to the dibasic acid containing an alkyl group and/or an alkenyl group or the salt thereof, there may also be used conventionally known emulsifiers unless the use thereof adversely affects the effects of the present invention. Examples of the known emulsifiers include monobasic acid salts such as sodium stearate, potassium oleate and sodium dodecylbenzenesulfonate; polybasic acid salts such as poly (sodium acrylate); polymer dispersants such as polyvinyl alcohol.

In the present invention, as the releasing agent constituting the releasing agent dispersion for toner, there may be suitably used any known releasing agent for toners. Examples of the releasing agent include paraffin-based, olefin-based, natural or synthetic fatty ester-based, fatty amide-based and long-chain alkyl ketone-based releasing agents. Specific examples of the releasing agent include olefin-based waxes such as low-molecular weight polyethylene and low-molecular weight polypropylene; natural or synthetic ester-based waxes containing a long-chain aliphatic group; ketones containing a long-chain alkyl group; higher fatty acids; and higher fatty amides. Among these releasing agents, from the viewpoints of a good emulsification stability of the releasing agent dispersion as well as a good durability of the toner obtained by using the releasing agent dispersion, preferred are those containing a carbonyl group-containing compound; more preferred are natural or synthetic ester-based waxes containing a long-chain aliphatic group which are represented by the following general formula (I):

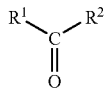

(1)

wherein $R^1$ is an aliphatic hydrocarbon group or an aromatic hydrocarbon group; and $R^2$ is an aliphatic hydrocarbon group, an aromatic hydrocarbon group or an alkoxy group, with the proviso that a total number of carbon atoms contained in $R^1$ and $R^2$ is from 20 to 90, or ketone waxes; and even more preferred are the natural or synthetic ester-based waxes containing a long-chain aliphatic group.

In the present invention, these releasing agents may be used alone or in combination of any two or more thereof.

From the viewpoints of a good emulsification stability and a good productivity, the releasing agent dispersion for toner according to the present invention contains the releasing agent in an amount of preferably from 5 to 40% by weight, more preferably from 15 to 40% by weight and still more preferably from 15 to 35% by weight.

The melting point of the releasing agent used in the present invention is preferably from 50 to 100° C. and more preferably from 70 to 95% by weight from the viewpoints of a good releasing effect, a good chargeability and a good durability. The melting point of the releasing agent may be measured using a differential scanning calorimeter, more specifically by the below-mentioned method.

The releasing agent dispersion for toner according to the present invention may be produced by emulsifying the releasing agent in the presence of the dibasic acid containing an alkyl group and/or an alkenyl group, or the salt thereof.

More specifically, the releasing agent is dispersed in a medium such as, for example, an aqueous medium in the presence of the dibasic acid containing an alkyl group and/or an alkenyl group, or the salt thereof, and while heating the obtained dispersion at a temperature not lower than a melting point of the releasing agent, dispersing the releasing agent to form fine particles thereof by using a homogenizer, a pressure discharge type homogenizer, a ultrasonic disperser, etc, which are capable of applying a strong shear force thereto, thereby obtaining a dispersion containing releasing agent particles having a volume median particle size ($D_{50}$) of preferably 1 μm or less.

The aqueous medium contains water as a main component. From the viewpoint of environmental protection, the content of water in the aqueous medium is preferably 80% by weight or more, more preferably 90% by weight or more and most preferably 100% by weight.

Examples of components other than water which can be contained in the aqueous medium include water-soluble organic solvents such as methanol, ethanol, isopropanol, butanol, acetone, methyl ethyl ketone and tetrahydrofuran. Among these water-soluble organic solvents, preferred are alcohol-based organic solvents such as methanol, ethanol, isopropanol and butanol. In the present invention, the releasing agent is more preferably dispersed in water solely without using substantially no organic solvent to form fine particles thereof.

The solid content of the releasing agent upon dispersing is preferably from 5 to 40% by weight, more preferably from 10 to 35% by weight and still more preferably from 15 to 35% by weight from the viewpoints of a good emulsifiability and a good productivity. In addition, from the viewpoint of a good storage stability, the pH of the releasing agent dispersion as measured at 25° C. is preferably from 5 to 10 and more preferably from 6 to 9.5.

The weight ratio of a sum of the dibasic acid containing an alkyl group and/or an alkenyl group and the salt thereof to the releasing agent (total weight of the dibasic acid and the salt thereof/weight of the releasing agent) in the obtained releasing agent dispersion, or the weight ratio of the dibasic acid containing an alkyl group and/or an alkenyl group or the salt thereof to the releasing agent (weight of the dibasic acid or the salt thereof/weight of the releasing agent) used upon dispersing, is preferably from 0.5/100 to 10/100, more preferably from 0.5/100 to 5/100 and even more preferably from 0.5/100 to 3/100 from the viewpoints of a good emulsifiability and a good chargeability of the toner.

Also, the temperature used upon dispersing is preferably from 60 to 120° C., more preferably from 80 to 110° C. and even more preferably from 80 to 100° C. in the viewpoint of a good emulsifiability of the releasing agent.

From the viewpoints of a good fixing property and a good durability of the toner, the volume median particle size ($D_{50}$) of the releasing agent particles in the dispersion is preferably 1 μm or smaller, more preferably from 0.05 to 1 μm and even more preferably from 0.1 to 0.85 μm. Meanwhile, the "volume median particle size ($D_{50}$)" used herein means a particle size at which a cumulative volume frequency calculated on the basis of a volume fraction of particles from a smaller particle size side thereof is 50%.

The thus-constructed releasing agent dispersion for toner according to the present invention can exhibit an excellent emulsifiability. The releasing agent particles contained in the releasing agent dispersion preferably have a narrow particle size distribution from the viewpoints of a good fixing property, a good durability and a good aggregating property of the toner. More specifically, the CV value of the releasing agent particles [(standard deviation of particle size distribution/volume median particle size ($D_{50}$))×100] is preferably 50 or less, more preferably 45 or less and even more preferably 40 or less. Meanwhile, the particle size and the particle size distribution of the releasing agent particles may be measured by using a light-scattering type particle size distribution measuring apparatus, more specifically, by the below-mentioned method.

The thus obtained releasing agent dispersion for toner according to the present invention exhibits a good emulsifiability and a good emulsification stability, and can be kept stable for a long period of time. In addition, the releasing agent dispersion is capable of producing a toner with an excellent productivity owing to an improved aggregating property thereof, and can be therefore suitably used for production of a toner for electrophotography.

The present invention also provides a process for producing the releasing agent dispersion for toner which includes the step of dispersing the releasing agent in an aqueous medium in the presence of the dibasic acid containing an alkyl group and/or an alkenyl group, at least one acid group of which is a carboxyl group, or the salt of the dibasic acid while heating at a temperature not lower than a melting point of the releasing agent.

The specific process for producing the releasing agent dispersion is the same as described above for explaining the releasing agent dispersion.

The releasing agent dispersion of the present invention has a good emulsifiability and a good emulsification stability and can be kept stable for a long period of time, and further can impart excellent productivity, durability and low-temperature fixing property to the resultant toner. Therefore, the releasing agent dispersion of the present invention can be suitably used for a toner for electrophotography which is employed for electrophotography, electrostatic recording method, electrostatic printing method or the like.

[Toner for Electrophotography]

Next, the toner for electrophotography according to the present invention is described.

The toner for electrophotography according to the present invention is produced by aggregating and unifying releasing agent particles and resin particles contained in a dispersion produced by mixing or contacting the above releasing agent dispersion for toner according to the present invention, with a resin dispersion.

The resin dispersion used for producing the toner for electrophotography according to the present invention, is a dispersion containing the resin particles obtained by emulsifying a resin binder.

Resin Binder

The resin binder used in the toner for electrophotography according to the present invention preferably contains a polyester from the viewpoints of a good fixing property and a good durability of the toner. The content of the polyester in the resin binder is preferably 60% by weight or larger, more preferably 70% by weight or larger, even more preferably 80% by weight or larger and further even more preferably substantially 100% by weight from the viewpoints of a good fixing property and a good durability of the resultant toner.

Examples of resins other than the polyester which may be contained in the resin binder include known resins conventionally used for toners such as styrene-acryl copolymers, epoxy resins, polycarbonates and polyurethanes.

The raw monomers of the polyester are not particularly limited, and there may be used a known alcohol component and a known carboxylic acid component such as a carboxylic acid, a carboxylic acid anhydride and a carboxylic acid ester.

Specific examples of the alcohol component include alkylene ($C_2$ to $C_3$) oxide adducts (average molar number of addition: 1 to 16) of bisphenol A such as polyoxypropylene-2,2-bis(4-hydroxyphenyl)propane and polyoxyethylene-2,2-bis(4-hydroxyphenyl)propane, ethylene glycol, propylene glycol, glycerol, pentaerythritol, trimethylol propane, hydrogenated bisphenol A, sorbitol, and alkylene ($C_2$ to $C_4$) oxide adducts (average molar number of addition: 1 to 16) thereof.

These alcohol components may be used alone or in combination of any two or more thereof.

Examples of the carboxylic acid component include dicarboxylic acids such as phthalic acid, isophthalic acid, terephthalic acid, fumaric acid, maleic acid, adipic acid and succinic acid; succinic acids substituted with an alkyl group having 1 to 20 carbon atoms or an alkenyl group having 2 to 20 carbon atoms such as dodecenylsuccinic acid and octenylsuccinic acid; tri- or higher-valent polycarboxylic acids such as trimellitic acid and pyromellitic acid; and anhydrides and alkyl ($C_1$ to $C_3$) esters of these acids.

These carboxylic acid components may be used alone or in combination of any two or more thereof.

The polyester may be produced, for example, by polycondensing the alcohol component and the carboxylic acid component in an inert gas atmosphere at a temperature of about 180 to 250° C., if required, by using an esterification catalyst.

Examples of the esterification catalyst include tin compounds such as dibutyl tin oxide and tin dioctylate, and titanium compounds such as titanium diisopropylate bistriethanol aminate. The amount of the esterification catalyst used is preferably from 0.01 to 1 part by weight and more preferably from 0.1 to 0.6 part by weight on the basis of 100 parts by weight of a sum of the alcohol component and the carboxylic acid component.

From the viewpoint of a good storage property of the resultant toner, the polyester preferably has a softening point of 70 to 165° C. and a glass transition point of 50 to 85° C. The acid value of the polyester is preferably from 6 to 35 mg KOH/g, more preferably from 10 to 35 mg KOH/g and still more preferably from 15 to 35 mg KOH/g from the viewpoint of facilitated production of the emulsion. The softening point or the acid value of the polyester may be desirably adjusted by controlling the temperature and time used in the polycondensation reaction.

From the viewpoint of a good durability of the resultant toner, the number-average molecular weight of the polyester is preferably from 1,000 to 10,000 and more preferably from 2,000 to 8,000.

Meanwhile, when the resin binder is composed of a plurality of resins, the softening point, glass transition point, acid value and number-average molecular weight of the resin binder all mean those values of a mixture of these resins.

Further, from the viewpoints of a good fixing property and a good durability of the toner, the resin binder used in the toner of the present invention may contain two kinds of polyesters which are different in softening point from each other in which one polyester (a) preferably has a softening point of 70 to 115° C., and the other polyester (b) preferably has a softening point of 115 to 165° C.

The weight ratio of the polyester (a) to the polyester (b) (a/b) in the resin binder is preferably from 10/90 to 90/10 and more preferably from 50/50 to 90/10.

Resin Dispersion

The resin particles contained in the resin dispersion contain at least the resin binder, if required, together with various additives such as a colorant and a charge control agent.

The colorant is not particularly limited, and may be appropriately selected from known colorants according to the aims or requirements. Specific examples of the colorant include various pigments such as carbon blacks, inorganic composite oxides, Chrome Yellow, Hansa Yellow, Benzidine Yellow, Threne Yellow, Quinoline Yellow, Permanent Orange GTR, Pyrazolone Orange, Vulcan Orange, Watchung Red, Permanent Red, Brilliant Carmine 3B, Brilliant Carmine 6B, DuPont Oil Red, Pyrazolone Red, Lithol Red, Rhodamine B Lake, Lake Red C, red iron oxide, Aniline Blue, ultramarine blue, Calco Oil Blue, Methylene Blue Chloride, Phthalocyanine Blue, Phthalocyanine Green and Malachite Green Oxalate; and various dyes such as acridine dyes, xanthene dyes, azo dyes, benzoquinone dyes, azine dyes, anthraquinone dyes, indigo dyes, thioindigo dyes, phthalocyanine dyes, Aniline Black dyes and thiazole dyes. These colorants may be used alone or in combination of any two or more thereof.

The content of the colorant in the resin dispersion is preferably 20 parts by weight or smaller and more preferably from 0.01 to 10 parts by weight on the basis of 100 parts by weight of the resin binder.

Examples of the charge control agent include metal salts of benzoic acid, metal salts of salicylic acid, metal salts of alkylsalicylic acids, metal salts of catechol, metal-containing bisazo dyes, tetraphenyl borate derivatives, quaternary ammonium salts and alkyl pyridinium salts.

The content of the charge control agent in the resin dispersion is preferably 10 parts by weight or smaller and more preferably from 0.01 to 5 parts by weight on the basis of 100 parts by weight of the resin binder.

In the present invention, upon emulsifying the resin binder, from the viewpoints of a good emulsification stability of the resin binder, etc., a surfactant is present in an amount of preferably 5 parts by weight or smaller, more preferably from 0.1 to 3.5 parts by weight and still more preferably from 0.1 to 3 parts by weight on the basis of 100 parts by weight of the resin binder.

Examples of the surfactant include anionic surfactants such as sulfate-based surfactants, sulfonate-based surfactants, phosphate-based surfactants and soap-based surfactants; cationic surfactants such as amine salt-type surfactants and quaternary ammonium salt-type surfactants; and nonionic surfactants such as polyethylene glycol-based surfactants, alkyl phenol ethyleneoxide adduct-based surfactants and polyhydric alcohol-based surfactants. Among these surfactants, preferred are ionic surfactants such as anionic surfactants and cationic surfactants. The nonionic surfactant is preferably used in combination with the anionic surfactant or the cationic surfactant. These surfactants may be used alone or in combination of any two or more thereof. Specific examples of the anionic surfactants include sodium dodecylbenzenesulfonate, sodium dodecylsulfate, sodium alkylethersulfates, sodium alkylnaphthalenesulfonates and sodium dialkylsulfosuccinates.

Specific examples of the cationic surfactants include alkylbenzenedimethyl ammonium chlorides, alkyltrimethyl ammonium chlorides and distearyl ammonium chloride.

Also, in the emulsification treatment, the resin binder is preferably dispersed together with optional additives in the aqueous medium by adding an aqueous alkali solution thereto.

The aqueous alkali solution used for dispersing the resin binder preferably has a concentration of from 1 to 20% by weight, more preferably from 1 to 10% by weight and even more preferably from 1.5 to 7.5% by weight. As the alkali of the aqueous alkali solution, there may be used such an alkali capable of enhancing a surface activity of its salt of the polyester. Examples of the alkali include hydroxides of a monovalent alkali metal such as potassium hydroxide and sodium hydroxide.

After dispersing the resin binder in the aqueous medium, the resultant dispersion is neutralized at a temperature not lower than the glass transition point of the resin binder, and then an aqueous medium is added thereto at a temperature not lower than the glass transition point of the resin binder to cause a phase inversion and emulsify the resin binder, thereby preparing the resin dispersion.

The velocity of addition of the aqueous medium is preferably from 0.5 to 50 g/min, more preferably from 0.5 to 40 g/min and still more preferably from 0.5 to 30 g/min per 100 g of the resin from the viewpoint of efficiently conducting the emulsifying step. The velocity of addition of the aqueous medium may be generally maintained until an O/W type emulsion is substantially formed. Therefore, the velocity of addition of the aqueous medium after forming the O/W type emulsion is not particularly limited.

Examples of the aqueous medium used upon production of the resin dispersion include the same aqueous media as those described above for the releasing agent dispersion for toner.

The amount of the aqueous medium used is preferably from 100 to 2000 parts by weight and more preferably from 150 to 1500 parts by weight on the basis of 100 parts by weight of the resin binder from the viewpoint of obtaining uniform aggregated particles in the subsequent aggregating treatment.

From the viewpoint of preparing a resin dispersion containing fine resin particles, the above emulsification is preferably conducted at a temperature not lower than the glass transition point of the resin binder and not higher than the softening point thereof. When the emulsification is conducted in the above-specified temperature range, the resin binder can be smoothly emulsified in the aqueous medium, and any special apparatus is not required therefor. From these viewpoints, the temperature used for the emulsification is preferably not lower than the temperature which is higher by 10° C. than the glass transition point of the resin binder (hereinafter referred to as the "glass transition point of the resin binder +(plus) 10° C.") and not higher than the temperature which is lower by 5° C. than the softening point of the resin binder (hereinafter referred to as the "softening point of the resin binder −(minus) 5° C.").

The volume-median particle size ($D_{50}$) of the resin particles contained in the thus obtained resin dispersion is preferably from 0.02 to 2 μm, more preferably from 0.05 to 1 μm and even more preferably from 0.05 to 0.6 μm for the purpose of uniform aggregation thereof in the subsequent aggregating step.

The toner for electrophotography according to the present invention is produced by mixing or contacting the thus obtained resin dispersion with the releasing agent dispersion for toner according to the present invention to prepare a mixed dispersion, and then aggregating and unifying releasing agent particles and resin particles contained in the mixed dispersion. More specifically, the toner can be produced by the process including the step (A) of aggregating releasing agent particles and resin particles contained in a dispersion produced by mixing or contacting the releasing agent dispersion with the resin dispersion, and the step (B) of unifying the aggregated particles obtained in the above step (A).

(A) Aggregating Step

In the aggregating step (A), first, the releasing agent dispersion of the present invention is mixed or contacted with the above resin dispersion.

In this case, from the viewpoints of a good dispersibility in the resin binder and a good fixing property of the resultant toner, the releasing agent dispersion and the resin dispersion are mixed or contacted with each other such that the releasing agent is preferably present in an amount of 1 to 20 parts by weight, more preferably 1.5 to 15 parts by weight and even more preferably 1.5 to 10 parts by weight on the basis of 100 parts by weight of the resin binder.

The solid content in the reaction system upon mixing or contacting is preferably from 5 to 50% by weight, more preferably from 5 to 30% by weight and still more preferably from 5 to 20% by weight in order to ensure uniform aggregation.

The pH of the reaction system in the aggregating step is preferably from 2 to 10, more preferably from 3 to 9 and even more preferably from 4 to 8 from the viewpoint of satisfying both a good dispersion stability of the dispersions to be mixed or contacted and a good aggregating property of respective particles in the subsequent step.

In the aggregating step (A), next, the releasing agent particles and the resin particles contained in the resultant mixed dispersion are aggregated together. In the aggregating step, in order to effectively carry out the aggregation, an aggregating agent is preferably added. Examples of the aggregating agent include a cationic surfactant in the form of a quaternary salt, an organic aggregating agent such as polyethyleneimine, and an inorganic aggregating agent such as an inorganic metal salt, an ammonium salt and a di- or higher-valent metal complex. The inorganic metal salt includes, for example, metal salts such as sodium sulfate, sodium chloride, calcium chloride, calcium nitrate, barium chloride, magnesium chloride, zinc chloride, aluminum chloride and aluminum sulfate; and inorganic metal salt polymers such as poly(aluminum chloride), poly(aluminum hydroxide) and poly(calcium sulfide).

Examples of the ammonium salt include ammonium halides, ammonium sulfate, ammonium chloride, ammonium acetate, ammonium benzoate and ammonium salicylate, and quaternary ammonium salts such as tetraalkyl ammonium halides. Among these ammonium salts, from the viewpoint of a good productivity, preferred are ammonium sulfate, ammonium chloride, tetraethyl ammonium bromide and tetrabutyl ammonium bromide.

The amount of the aggregating agent used is preferably 30 parts by weight or smaller and more preferably 25 parts by weight or smaller on the basis of 100 parts by weight of the resin binder from the viewpoints of a good environmental resistance of the resultant toner.

In order to ensure a uniform aggregation, the aggregating agent is preferably added after controlling the pH of the reaction system in the aggregating step, and at a temperature not higher than the glass transition point of the resin and preferably at a temperature not higher than the temperature calculated from the "glass transition point of the resin binder −(minus) 10° C.". Also, the aggregating agent may be added in the form of an aqueous solution thereof. Further, the mixture obtained upon and after addition of the aggregating agent is preferably fully stirred.

From the viewpoint of a high image quality, the volume median particle size ($D_{50}$) of the aggregated particles is preferably from 1 to 10 μm, more preferably from 2 to 10 μm and even more preferably from 3 to 10 μm.

In the present invention, by using the above releasing agent dispersion for toner according to the present invention in the step (A), the aggregating property of the particles, namely a productivity of the toner, can be considerably enhanced.

(B) Unifying Step

The step (B) is a step for unifying the aggregated particles obtained in the step (A).

In the present invention, the aggregated particles constituted of at least the resin particles and the releasing agent particles which are obtained in the above aggregating step are unified by heating these particles to a temperature not lower than the glass transition point of the neutralized resin binder. The heating temperature used upon the unifying step is preferably not lower than the glass transition point of the resin binder and not higher than the temperature calculated from the "softening point of the resin binder +(plus) 20° C."; more preferably not lower than the temperature calculated from the "glass transition point of the resin binder +(plus) 5° C." and not higher than the temperature calculated from the "softening point of the resin binder +(plus) 15° C."; and even more preferably not lower than the temperature calculated from the "glass transition point of the resin binder +(plus) 10° C." and not higher than the temperature calculated from the "softening point of the resin binder +(plus) 10° C." from the viewpoint of controlling a particle size, a particle size distribution and a shape of the toner as desired, and attaining a good fusibility of the aggregated particles. In addition, the stirring rate is preferably a rate at which the aggregated particles are not precipitated.

The thus obtained unified particles may be subjected to a liquid-solid separation step such as filtration, a washing step, a drying step, etc., thereby obtaining toner particles. In the washing step, the unified particles are preferably washed with an acid to remove metal ions from the surface of the respective toner particles for the purpose of ensuring a sufficient chargeability and a good reliability of the resultant toner.

In addition, in the drying step, any optional methods such as vibration-type fluidization drying method, spray-drying method, freeze-drying method and flash jet method may be employed. The water content in the toner particles obtained after drying is preferably adjusted to 1.5% by weight or less and more preferably 1.0% by weight or less from the viewpoint of a good chargeability of the resulting toner.

The volume median particle size ($D_{50}$) of the unified particles is preferably from 1 to 10 μm, more preferably from 2 to 8 μm and still more preferably from 3 to 7 μm from the viewpoints of a high image quality.

Toner for Electrophotography

The toner for electrophotography according to the present invention has a spherical shape, a small particle size and a narrow particle size distribution which are suitable for realizing a high definition and a high image quality, and exhibits an excellent fixing property.

The obtained toner preferably has a softening point of from 60 to 140° C., more preferably from 60 to 130° C. and even more preferably from 60 to 120° C. from the viewpoint of a good low-temperature fixing property. In addition, the toner preferably has a glass transition point of from 30 to 80° C. and more preferably from 40 to 70° C. from the viewpoint of a good durability. Meanwhile, the softening point and the glass transition point of the toner may be measured according to the same methods as used above for measuring those of the resins.

In the toner for electrophotography according to the present invention, an external additive such as a fluidizing agent may be added to the surface of the toner particles. As the external additive, there may be used known fine particles. Examples of the fine particles include inorganic fine particles such as fine silica particles whose surface is subjected to a hydrophobic treatment, fine titanium oxide particles, fine alumina particles, fine cerium oxide particles and carbon blacks; and fine polymer particles such as fine particles made of polycarbonates, polymethyl methacrylate, silicone resins, etc.

The volume median particle size ($D_{50}$) of the toner particles is preferably from 1 to 10 μm, more preferably from 2 to 8 μm and even more preferably from 3 to 7 μm from the viewpoint of a high image quality. Also, the CV values of the above aggregated particles, unified particles and toner particles all are preferably 30 or less, more preferably 25 or less and still more preferably 20 or less. The particle size and the particle size distribution of the toner particles may be measured by the below-mentioned methods.

The toner for electrophotography obtained according to the present invention can be used as one-component system developer, or can be mixed with a carrier to form a two-component system developer.

In accordance with the present invention, there are provided the releasing agent dispersion which can exhibit a good emulsifiability and a good emulsification stability and is capable of producing the toner with an excellent productivity, and a process for producing the releasing agent dispersion. Further, by using the releasing agent dispersion, there are also provided the toner for electrophotography which is excellent in productivity, durability and low-temperature fixing property, and a process for producing the toner.

The present invention is described in more detail by referring to the following examples. However, it should be noted that these examples are only illustrative and not intended to limit the invention thereto.

In the following Production Examples, Examples and Comparative Examples, various properties were measured and evaluated by the following methods.

[Acid Value of Resins]

Determined according to JIS K0070. However, as the solvent for the measurement, there was used a mixed solvent containing acetone and toluene at a volume ratio of 1:1.

[Softening Point and Glass Transition Point of Resins]

(1) Softening Point

Using a flow tester "CFT-500D" available from Shimadzu Seisakusho Co., Ltd., 1 g of a sample was extruded through a nozzle having a die pore diameter of 1 mm and a length of 1 mm while heating the sample at a temperature rise rate of 6° C./min and applying a load of 1.96 MPa thereto by a plunger. The softening point was determined as the temperature at which a half the amount of the sample was flowed out when plotting a downward movement of the plunger of the flow tester relative to the temperature.

(2) Glass Transition Point

Using a differential scanning calorimeter ("DSC 210" commercially available from Seiko Instruments, Inc.), a sample was heated to 200° C. and then cooled from 200° C. to 0° C. at a temperature drop rate of 10° C./min, and thereafter heated again at temperature rise rate of 10° C./min to measure a glass transition point thereof. When a peak was observed at a temperature lower by 20° C. or more than the softening point, the peak temperature was read as the glass transition point. Whereas, when a shift of the characteristic curve was observed without any peaks at the temperature lower by 20° C. or more than the softening point, the temperature at which a tangential line having a maximum inclination of the curve in the portion of the curve shift was intersected with an extension of the baseline on the high-temperature side of the curve shift was read as the glass transition point. Meanwhile, the glass transition point is a property inherent to an amorphous portion of the resin, which may be generally observed in an amorphous polyester, or may be also observed in an amorphous portion of a crystalline polyester in some cases.

[Number-Average Molecular Weight of Resins]

The number-average molecular weight was calculated from the molecular weight distribution measured by gel permeation chromatography according to the following method.

(1) Preparation of Sample Solution

The resin binder was dissolved in chloroform to prepare a solution having a concentration of 0.5 g/100 mL. The resultant solution was then filtered through a fluororesin filter ("FP-200" commercially available from Sumitomo Electric Industries, Ltd.) having a pore size of 2 μm to remove insoluble components therefrom, thereby obtaining a sample solution.

(2) Determination of Molecular Weight Distribution

Using the below-mentioned analyzer, chloroform was allowed to flow therethrough at a rate of 1 mL/min, and the column was stabilized in a thermostat at 40° C. One-hundred microliters of the sample solution was injected to the column to determine the molecular weight distribution. The molecular weight of the sample was calculated on the basis of a calibration curve previously prepared. The calibration curve of the molecular weight was prepared by using several kinds of monodisperse polystyrenes (those polystyrenes having molecular weights of $2.63\times10^3$, $2.06\times10^4$ and $1.02\times10^5$ available from Tosoh Corporation; and those polystyrenes having molecular weights of $2.10\times10^3$, $7.00\times10^3$ and $5.04\times10^4$ available from GL Science Co., Ltd.) as standard samples.

Analyzer: CO-8010 (commercially available from Tosoh Corporation)

Column: GMHLX+G3000HXL (commercially available from Tosoh Corporation)

[Melting Point of Releasing Agent]

Using a differential scanning calorimeter ("DSC 210" commercially available from Seiko Instruments, Inc.), a sample was heated from 20° C. at a temperature rise rate of 10° C./min to measure peak temperatures thereof. The maximum peak temperature was determined as a melting point of the sample.

[Particle Size and Particle Size Distribution of Dispersed Resin Particles, Releasing Agent Particles, Aggregated Particles and Unified Particles]

(1) Measuring Apparatus: Laser diffraction particle size analyzer ("LA-920" commercially available from Horiba Seisakusho Co., Ltd.)

(2) Measuring Conditions: Using a cell for the measurement which was filled with distilled water, a volume median particle size ($D_{50}$) of the particles was measured at a temperature at which an absorbance thereof was within an adequate range. Meanwhile, the particle size distribution was indicated by the CV value calculated according to the following formula:

$$CV\ \text{Value}=(\text{Standard Deviation of Particle Size Distribution/Volume Median Particle Size}(D_{50}))\times 100$$

Upon the above measurement, it was assumed that the relative reflectance against water was 1.2 for the resin particles, aggregated particles and unified particles, and 1.1 for the releasing agent particles.

[Particle Size and Particle Size Distribution of Toner]

Measuring Apparatus Coulter Multisizer II (commercially available from Beckman Coulter Inc.)

Aperture Diameter: 50 μm

Analyzing Software: Coulter Multisizer AccuComp Ver. 1.19 (commercially available from Beckman Coulter Inc.)

Electrolyte Solution: "Isotone II" (commercially available from Beckman Coulter Inc.)

Dispersing Solution The dispersing solution was prepared by dissolving "EMULGEN 109P" (commercially available from Kao Corporation; polyoxyethylene lauryl ether; HLB: 13.6) in the above electrolyte solution such that the concentration of "EMULGEN 109P" in the obtained solution was 5% by weight.

Dispersing Conditions: Ten milligrams of a sample to be measured was added to 5 mL of the dispersing solution, and dispersed using an ultrasonic disperser for 1 min. Thereafter, 25 mL of the electrolyte solution was added to the dispersion, and the obtained mixture was further dispersed using the ultrasonic disperser for 1 min to prepare a sample dispersion.

Measuring Conditions: The thus prepared sample dispersion was added to 100 mL of the electrolyte solution, and after controlling a concentration of the resultant dispersion such that the determination for 30000 particles were completed within 20 s, the particle sizes of 30000 particles were measured under such a concentration condition, and a volume median particle size ($D_{50}$) thereof was determined from the particle size distribution.

Meanwhile, the particle size distribution was indicated by the CV value calculated according to the following formula:

$$CV\ \text{Value}=(\text{Standard Deviation of Particle Size Distribution/Volume Median Particle Size}(D_{50}))\times 100$$

Production Example 1

Production of Polyester A

Under a nitrogen atmosphere, 8320 g of polyoxypropylene (2.2)-2,2-bis(4-hydroxyphenyl)propane, 80 g of polyoxyethylene(2.0)-2,2-bis(4-hydroxyphenyl)propane, 1592 g of terephthalic acid and 32 g of dibutyl tin oxide as an esterification catalyst were reacted with each other under normal pressure (101.3 kPa) at 230° C. for 5 h, and further reacted under reduced pressure (8 kPa). After the obtained reaction product was cooled to 210° C., 1672 g of fumaric acid and 8 g of hydroquinone were added thereto to conduct a reaction therebetween for 5 h, and further the reaction was conducted under reduced pressure, thereby obtaining a polyester A. The polyester A had a softening point of 110° C., a glass transition point of 66° C., an acid value of 24.4 mg KOH/g, and a number-average molecular weight of 3760.

Production Example 2

Production of Polyester B

A four-necked flask equipped with a nitrogen inlet tube, a dehydration tube, a stirrer, and a thermocouple was charged with 17500 g of polyoxypropylene(2.2)-2,2-bis(4-hydroxyphenyl)propane, 16250 g of polyoxyethylene(2.0)-2,2-bis(4-hydroxyphenyl)propane, 11454 g of terephthalic acid, 1608 g of dodecenyl succinic anhydride, 4800 g of trimellitic anhydride and 15 g of dibutyl tin oxide as an esterification catalyst, and the contents of the flask were reacted with each other at 220° C. under a nitrogen atmosphere while stirring until the softening point as measured according to ASTM D36-86 reached 120° C., thereby obtaining a polyester B. The polyester B had a softening point of 121° C., a glass transition point of 65° C., an acid value of 18.5 mg KOH/g and a number-average molecular weight of 3394.

Production Example 3

Production of Master Batch 1

Seventy parts by weight of fine particles of the polyester A obtained in Production Example 1 and 30 parts by weight of a slurry pigment of copper phthalocyanine ("ECB-301"; solid content: 46.2% by weight) available from Dai-Nichi Seika Co., Ltd., were charged into a Henschel mixer, and mixed with each other for 5 min to obtain a wet mixture. The resulting mixture was charged into a kneader-type mixer and gradually heated. The resin was melted at a temperature of about 90 to 110° C., and the mixture was kneaded in the condition that water was still present therein, and further continuously kneaded at a temperature of 90 to 110° C. for 20 min while evaporating water therefrom.

The resultant kneaded material was continuously kneaded at 120° C. to evaporate a residual water therefrom, and dehydrated and dried, and further continuously kneaded at a temperature of 120 to 130° C. for 10 min. After cooling, the obtained kneaded material was further kneaded with a heating three-roll mill, cooled and coarsely crushed, thereby obtaining a high-concentration colored composition in the form of coarse particles containing 30% by weight of a blue pigment (master batch 1). The resultant composition was placed on a slide glass, and heat-melted. As a result of observing the melted composition by using a microscope, it was confirmed that the pigment particles were entirely finely dispersed in the composition, and no coarse particles were present therein.

Example 1

After 3.57 g of an aqueous solution of dipotassium alkenyl (mixture of a hexadecenyl group and an octadecenyl group) succinate "LATEMUL ASK" (concentration of effective ingredients: 28% by weight) available from Kao Corp., was dissolved in 400 g of deionized water in a 1 L beaker, 100 g of a carnauba wax (melting point: 85° C.) available from Kato Yokoh Co., Ltd., was dispersed in the resultant solution. While maintaining the obtained dispersion at a temperature of 90 to 95° C., the dispersion was subjected to dispersing treatment for 60 min by using "Ultrasonic Homogenizer 600W" available from Nippon Seiki Co., Ltd., and then cooled to room temperature, thereby obtaining a releasing agent dispersion A.

Example 2

The same procedure as in Example 1 was repeated except that the amount of the aqueous solution of dipotassium alkenyl (mixture of a hexadecenyl group and an octadecenyl group) succinate "LATEMUL ASK" (concentration of effective ingredients: 28% by weight) available from Kao Corp., was changed from 3.57 g to 1.79 g, thereby obtaining a releasing agent dispersion B.

Example 3

The same procedure as in Example 1 was repeated except that the amount of the aqueous solution of dipotassium alkenyl (mixture of a hexadecenyl group and an octadecenyl group) succinate "LATEMUL ASK" (concentration of effective ingredients: 28% by weight) available from Kao Corp., was changed from 3.57 g to 17.9 g, thereby obtaining a releasing agent dispersion C.

Example 4

The same procedure as in Example 1 was repeated except that the amount of the aqueous solution of dipotassium alkenyl (mixture of a hexadecenyl group and an octadecenyl group) succinate "LATEMUL ASK" (concentration of effective ingredients: 28% by weight) available from Kao Corp., was changed from 3.57 g to 35.7 g, thereby obtaining a releasing agent dispersion D.

Example 5

The same procedure as in Example 1 was repeated except for using 100 g of an ester wax "NISSAN ELECTOL WEP-3" (melting point: 83° C.) available from NOF Corp., in place of 100 g of the carnauba wax (melting point: 85° C.) available from Kato Yokoh Co., Ltd., thereby obtaining a releasing agent dispersion E.

Example 6

The same procedure as in Example 1 was repeated except for using 100 g of an ester wax "NISSAN ELECTOL WEP-5" (melting point: 91° C.) available from NOF Corp., in place of 100 g of the carnauba wax (melting point: 85° C.) available from Kato Yokoh Co., Ltd., thereby obtaining a releasing agent dispersion F.

Example 7

The same procedure as in Example 1 was repeated except for using 100 g of an ester wax "NISSAN ELECTOL WEP-8" (melting point: 86° C.) available from NOF Corp., in place of 100 g of the carnauba wax (melting point: 85° C.) available from Kato Yokoh Co., Ltd., thereby obtaining a releasing agent dispersion G.

Example 8

The same procedure as in Example 1 was repeated except for using 100 g of a paraffin wax "HNP-9" (melting point: 77° C.) available from Nippon Seiroh Co., Ltd., in place of 100 g of the carnauba wax (melting point: 85° C.) available from Kato Yokoh Co., Ltd., thereby obtaining a releasing agent dispersion H.

Comparative Example 1

The same procedure as in Example 1 was repeated except for using 1 g of an aqueous solution of sodium dodecyldiphenyletherdisulfonate "PELEX SS-L" (concentration of effective ingredients: 50% by weight) available from Kao Corp., in place of 3.57 g of the aqueous solution of dipotassium alkenyl (mixture of a hexadecenyl group and an octadecenyl group) succinate "LATEMUL ASK" (concentration of effective ingredients: 28% by weight) available from Kao Corp., thereby obtaining a releasing agent dispersion I.

Comparative Example 2

The same procedure as in Example 1 was repeated except for using 10 g of an aqueous solution of sodium dodecyldiphenyletherdisulfonate "PELEX SS-L" (concentration of effective ingredients: 50% by weight) available from Kao Corp., in place of 3.57 g of the aqueous solution of dipotassium alkenyl (mixture of a hexadecenyl group and an octadecenyl group) succinate "LATEMUL ASK" (concentration of effective ingredients: 28% by weight) available from Kao Corp., thereby obtaining a releasing agent dispersion J.

Comparative Example 3

The same procedure as in Example 1 was repeated except for using 12.5 g of an aqueous solution of poly(sodium acrylate) "POISE 530" (concentration of effective ingredients: 40% by weight) available from Kao Corp., in place of 3.57 g of the aqueous solution of dipotassium alkenyl (mixture of a hexadecenyl group and an octadecenyl group) succinate "LATEMUL ASK" (concentration of effective ingredients: 28% by weight) available from Kao Corp., thereby obtaining a releasing agent dispersion K.

Comparative Example 4

The same procedure as in Example 1 was repeated except for using 25 g of an aqueous solution of poly(sodium acrylate) "POISE 530" (concentration of effective ingredients: 40% by weight) available from Kao Corp., in place of 3.57 g of the aqueous solution of dipotassium alkenyl (mixture of a hexadecenyl group and an octadecenyl group) succinate "LATEMUL ASK" (concentration of effective ingredients: 28% by weight) available from Kao Corp., thereby obtaining a releasing agent dispersion L.

Comparative Example 5

The same procedure as in Example 1 was repeated except for using 3.13 g of an aqueous solution of potassium oleate "OS SOAP" (concentration of effective ingredients: 16% by weight) available from Kao Corp., in place of 3.57 g of the aqueous solution of dipotassium alkenyl (mixture of a hexadecenyl group and an octadecenyl group) succinate "LATEMUL ASK" (concentration of effective ingredients: 28% by weight) available from Kao Corp., thereby obtaining a releasing agent dispersion M.

Comparative Example 6

The same procedure as in Example 1 was repeated except for using 31.3 g of an aqueous solution of potassium oleate "OS SOAP" (concentration of effective ingredients: 16% by weight) available from Kao Corp., in place of 3.57 g of the aqueous solution of dipotassium alkenyl (mixture of a hexadecenyl group and an octadecenyl group) succinate "LATEMUL ASK" (concentration of effective ingredients: 28% by weight) available from Kao Corp., thereby obtaining a releasing agent dispersion N.

The compositions of the respective releasing agent dispersions A to N obtained in Examples 1 to 8 and Comparative Examples 1 to 6 as well as the results of evaluation for various properties thereof are shown together in Table 1. Meanwhile, the values appearing in Table 1 represent amounts (g) of the respective components blended.

The emulsifiability, storage stability and aggregating property of the thus obtained releasing agent dispersions A to N were evaluated by the following methods. The results are shown in Table 1.

[Emulsifiability of Releasing Agent Dispersion]

The emulsifiability of the releasing agent dispersion was evaluated according to the following evaluation criteria.

A: Volume median particle size ($D_{50}$) of particles in releasing agent dispersion <1 μm; and CV<50

B: Volume median particle size ($D_{50}$) of particles in releasing agent dispersion <1 μm; and CV>50

C: Volume median particle size ($D_{50}$) of particles in releasing agent dispersion ≧1 μm; and CV>50

[Storage Stability of Releasing Agent Dispersion]

The storage stability of the releasing agent dispersion was evaluated according to the following evaluation criteria.

A: No separation of the dispersion into two phases (oil and water phases) occurred when observed by naked eyes after allowing the dispersion to stand at 25° C. for one month B: Separation of the dispersion into two phases (oil and water phases) occurred when observed by naked eyes after allowing the dispersion to stand at 25° C. for one month.

[Aggregating Suitability of Releasing Agent Dispersion]

One gram of a 2.3 mol/L ammonium sulfate aqueous solution was added to 50 g of the releasing agent dispersion at room temperature, and after stirring the resultant mixture for 10 min, the particle size of the obtained aggregated particles was measured. However, the aggregating suitability was evaluated as to only the releasing agent dispersions having an excellent emulsifiability, i.e., those having a volume median particle size ($D_5$) of 1 μm or less and a CV value of less than 50.

TABLE 1

| | Examples | | | | | | | |
|---|---|---|---|---|---|---|---|---|
| | 1 | 2 | 3 | 4 | 5 | 6 | 7 | 8 |
| Releasing agent dispersion | A | B | C | D | E | F | G | H |
| Carnauba wax | 100 | 100 | 100 | 100 | — | — | — | — |
| Ester wax (WEP-3) | — | — | — | — | 100 | — | — | — |
| Ester wax (WEP-5) | — | — | — | — | — | 100 | — | — |
| Ester wax (WEP-8) | — | — | — | — | — | — | 100 | — |
| Paraffin wax (HNP9) | — | — | — | — | — | — | — | 100 |
| Deionized water | 400 | 400 | 400 | 400 | 400 | 400 | 400 | 400 |
| Mixture of dipotassium hexadecenylsuccunate and dipotassium octadecenylsuccunate | 1 | 0.5 | 5 | 10 | 1 | 1 | 1 | 1 |
| Sodium dodecyldiphenyletherdisulfonate | — | — | — | — | — | — | — | — |
| Poly(sodium acrylate) | — | — | — | — | — | — | — | — |
| Potassium oleate | — | — | — | — | — | — | — | — |
| Weight ratio of dibasic acid salt to releasing agent | 1/100 | 0.5/100 | 5/100 | 10/100 | 1/100 | 1/100 | 1/100 | 1/100 |
| Volume median particle size ($D_{50}$) (μm) | 0.45 | 0.61 | 0.39 | 0.34 | 0.36 | 0.41 | 0.45 | 0.33 |
| CV value | 38 | 36 | 30 | 29 | 26 | 29 | 34 | 21 |
| pH | 7.1 | 6.7 | 7.6 | 8.3 | 9.6 | 9.3 | 9.5 | 9.5 |
| Solid content (wt %) | 22 | 22 | 26 | 23 | 22 | 22 | 21 | 22 |
| Emulsifiability of releasing agent dispersion | A | A | A | A | A | A | A | A |
| Storage stability of releasing agent dispersion | A | A | A | A | A | A | A | A |
| Aggregating suitability of releasing agent dispersion (particle size of aggregated particles (μm)) | 7.4 | 7.8 | 7.6 | 7.0 | 7.5 | 5.5 | 5.4 | 1.5 |

| | Comparative Examples | | | | | |
|---|---|---|---|---|---|---|
| | 1 | 2 | 3 | 4 | 5 | 6 |
| Releasing agent dispersion | I | J | K | L | M | N |
| Carnauba wax | 100 | 100 | 100 | 100 | 100 | 100 |
| Ester wax (WEP-3) | — | — | — | — | — | — |
| Ester wax (WEP-5) | — | — | — | — | — | — |
| Ester wax (WEP-8) | — | — | — | — | — | — |
| Paraffin wax (HNP9) | — | — | — | — | — | — |
| Deionized water | 400 | 400 | 400 | 400 | 400 | 400 |
| Mixture of dipotassium hexadecenylsuccunate and dipotassium octadecenylsuccunate | — | — | — | — | — | — |
| Sodium dodecyldiphenyletherdisulfonate | 0.5 | 5 | — | — | — | — |
| Poly(sodium acrylate) | — | — | 5 | 10 | — | — |
| Potassium oleate | — | — | — | — | 0.5 | 5 |
| Weight ratio of dibasic acid salt to releasing agent | 0.5/100 | 5/100 | 5/100 | 10/100 | 0.5/100 | 5/100 |

TABLE 1-continued

| | | | | | | |
|---|---|---|---|---|---|---|
| Volume median particle size ($D_{50}$) (μm) | 26.4 | 0.37 | 18.6 | 13.1 | 0.85 | 0.46 |
| CV value | 98 | 27 | 87 | 69 | 144 | 38 |
| pH | 3.9 | 4.3 | 7.6 | 8.5 | 6.8 | 8.3 |
| Solid content (wt %) | 23 | 24 | 23 | 25 | 23 | 22 |
| Emulsifiability of releasing agent dispersion | C | A | C | C | B | A |
| Storage stability of releasing agent dispersion | A | A | B | B | A | A |
| Aggregating suitability of releasing agent dispersion (particle size of aggregated particles (μm)) | — | 0.38 | — | — | — | 17 |

Production Example 4

Production of Resin Dispersion 1

A mixed resin composed of 800 g of the polyester A, 525 g of the polyester B and 250 g of the master batch 1 (the mixed resin obtained by mixing and melting the polyester A, the polyester B and the master batch 1 at such a mixing ratio had a softening point of 114° C. and a glass transition point of 64° C.), 100 g of an anionic surfactant "NEOPELEX G-15" (sodium dodecylbenzenesulfonate; solid content: 15% by weight) available from Kao Corporation, 15 g of a nonionic surfactant "EMULGEN 430" (polyoxyethylene (26 mol) oleyl ether; HLB: 16.2) available from Kao Corporation and 689 g of a 5 wt % potassium hydroxide aqueous solution were dispersed at 25° C. in a 5 liter-stainless steel pot while stirring with a paddle-shaped stirrer at a rate of 200 r/min. The contents of the pot were stabilized at 96° C., and held for 2 h while stirring with a paddle-shaped stirrer at a rate of 200 r/min. Successively, while stirring with a paddle-shaped stirrer at a rate of 200 r/min, 2845 g in total of deionized water was dropped into the pot at a rate of 15 g/min. During the dropping, at the time at which 750 g of deionized water was added, the viscosity of the dispersion in the reaction system reached a maximal value thereof. The temperature of the reaction system was maintained at 96° C. After cooling, the obtained reaction mixture was passed through a wire mesh having a 200 mesh screen (opening: 105 μm) to obtain a resin dispersion 1 containing fine resin particles. The resin particles in the resultant resin dispersion 1 had a volume median particle size of 0.14 μm and a solid content of 31.3% by weight. No residual resin components remained on the wire mesh.

Example 9

Production of Cyan Toner 1

Five hundred grams of the resin dispersion 1 and 35 g of the releasing agent dispersion A were charged into a 2 L glass container, and mixed with each other at room temperature. The pH value of the resultant mixed dispersion was 6.4. Then, while stirring the resultant mixed dispersion with a paddle-shaped stirrer at a rate of 100 r/min, an aqueous solution prepared by dissolving 34 g of ammonium sulfate (guaranteed reagent available from Sigma Aldrich Japan Co., Ltd.) as an aggregating agent in 382 g of deionized water was dropped into the mixed dispersion at room temperature over 10 min. Thereafter, the resultant mixed dispersion was heated to 55° C. at a rate of 0.17° C./min to form aggregated particles. The obtained dispersion was held at 55° C. for 3 h. Then, a dilute dispersion prepared by diluting 150 g of the resin dispersion 1 with 122 g of deionized water was dropped into the above dispersion at a rate of 2 mL/min. After completion of the dropping, an aqueous solution prepared by diluting 35 g of an anionic surfactant "EMULE E-27C" (a sodium polyoxyethylene laurylethersulfate aqueous solution; solid content: 28% by weight) available from Kao Corp., with 313 g of deionized water, was added to the resultant dispersion. At this time, the obtained aggregated particles had a volume median particle size ($D_{50}$) of 9.6 μm and a CV value of 25. Thereafter, the dispersion was heated to 80° C. at a rate of 0.14° C./min and stirred at 80° C. for 2 h, and the heating was stopped. During the above procedure, it was confirmed that the configuration of the toner was changed from the aggregated particles to unified particles.

The resultant dispersion was gradually cooled to room temperature, and then subjected to a suction filtration step, a washing step and a drying step to obtain fine colored resin particles (unified particles). The thus obtained fine colored resin particles had a volume median particle size ($D_{50}$) of 8.6 μm, a CV value of 24 and a water content of 0.4% by weight.

Next, a hydrophobic silica ("TS530" commercially available from Wacker Chemical Corp.; number-average primary particle size: 8 nm) was externally added to the fine colored resin particles in an amount of 1.0 part by weight on the basis of 100 parts by weight of the fine colored resin particles by using a Henschel mixer to obtain a cyan toner 1. The thus obtained cyan toner 1 had a volume median particle size ($D_{50}$) of 6.2 μm, a CV value of 24 and a water content of 0.4% by weight. The resultant cyan toner 1 was loaded to a commercially available full-color printer to form printed images. As a result, it was confirmed that the obtained printed images were good. Meanwhile, the cyan toner 1 had a glass transition point of 53° C. In addition, as a result of observing the waxes contained in the toner by TEM, it was confirmed that the waxes were in the form of a composite material.

Example 10

Production of Cyan Toner 2

The same procedure as in Example 9 was repeated except for using 33 g of the releasing agent dispersion B in place of 35 g of the releasing agent dispersion A, thereby obtaining a cyan toner 2.

The resultant cyan toner 2 was loaded to a commercially available full-color printer to form printed images. As a result, it was confirmed that the obtained printed images were good. In addition, as a result of observing the waxes contained in the toner by TEM, it was confirmed that the waxes were in the form of a composite material.

Example 11

Production of Cyan Toner 3

The same procedure as in Example 9 was repeated except for using 30 g of the releasing agent dispersion C in place of 35 g of the releasing agent dispersion A, thereby obtaining a cyan toner 3.

The resultant cyan toner 3 was loaded to a commercially available full-color printer to form printed images. As a result, it was confirmed that the obtained printed images were good. In addition, as a result of observing the waxes contained in the toner by TEM, it was confirmed that the waxes were in the form of a composite material.

Example 12

Production of Cyan Toner 4

The same procedure as in Example 9 was repeated except for using 32 g of the releasing agent dispersion D in place of 35 g of the releasing agent dispersion A, thereby obtaining a cyan toner 4.

The resultant cyan toner 4 was loaded to a commercially available full-color printer to form printed images. As a result, it was confirmed that the obtained printed images were good. In addition, as a result of observing the waxes contained in the toner by TEM, it was confirmed that the waxes were in the form of a composite material.

Comparative Example 7

Five hundred grams of the resin dispersion 1 and 32 g of the releasing agent dispersion I were charged into a 2 L glass container, and mixed with each other at room temperature. Then, while stirring the resultant mixture with a paddle-shaped stirrer at a rate of 100 r/min, an aqueous solution prepared by dissolving 34 g of ammonium sulfate (guaranteed reagent available from Sigma Aldrich Japan Co., Ltd.) as an aggregating agent in 382 g of deionized water was dropped into the mixture at room temperature over 10 min. Thereafter, the resultant mixed dispersion was heated to 55° C. at a rate of 0.17° C./min to form aggregated particles. The obtained dispersion was held at 55° C. for 3 h. As a result of observing the thus formed aggregated particles by an optical microscope, it was confirmed that although the resin was aggregated to some extent, the releasing agent was kept in a non-aggregated state and still in a dispersed state. Therefore, the procedure for production of the toner was interrupted.

Comparative Example 8

Production of Cyan Toner 5

The same procedure as in Example 9 was repeated except for using 35 g of the releasing agent dispersion N in place of 35 g of the releasing agent dispersion A, thereby obtaining a cyan toner 5.

As a result, it was confirmed that the resin and the releasing agent in the cyan toner 5 were not formed into a composite material, and the toner suffered from filming and failed to form a developed toner image when loaded in a commercially available full-color printer. In addition, as a result of observing the waxes contained in the toner by TEM, it was confirmed that the waxes were not formed into a composite material.

The volume median particle size ($D_{50}$) and CV value of the aggregated particles obtained in Examples 9 to 12 and Comparative Example 8, the volume median particle size ($D_{50}$), CV value and water content of the fine colored resin particles obtained therein as well as the volume median particle size ($D_{50}$), CV value, water content and glass transition point of the toners obtained therein, are shown together in Table 2.

The low-temperature fixing property and durability of the respective toners obtained in Examples 9 to 12 and Comparative Example 8 were evaluated by the following methods. The results are shown in Table 2.

<Minimum Fixing Temperature>

The obtained toners were respectively subjected to evaluation for fixing property thereof in a temperature range of from 100° C. to 200° C. at intervals of 10° C. using an oilless fixing device mounted in an electrophotographic printer of a non-magnetic one-component type which was capable of printing 23 sheets of A4 size in a longitudinal direction thereof for 1 min to measure a minimum fixing temperature of the toners. The minimum fixing temperature was determined as follows. That is, a mending tape was attached onto a solid toner image and then peeled off to examine a change in image density of the residual toner image. When the image density after peeling-off the mending tape was 90% or more of the original image density, the toner image was determined to be well-fixed.

<Durability>

Eighty grams of the obtained toner was loaded to a developing device dismounted from a printer "ML9800" available from Oki Data Co., Ltd. After stirring the toner in the developing device for 30 min by using a jig capable of allowing the developing device singly to rotate at an actual stirring speed, a developing roll therein was observed to examine whether or not any streaks or scores occurred thereon. When the number of the streaks or scores produced was 10 or less, the durability of the toner was determined to be practically acceptable.

<Formation of Wax Composite>

The obtained toner was enclosed and buried in an aqueous resin, and sliced into a thin piece by using a cryo-microtome. The microphotograph of the sliced piece obtained by a transmission type electron microscope (TEM) was observed to examine whether any wax was present in the resin particles.

TABLE 2

| | Aggregated particles | | Fine colored resin particles | | |
|---|---|---|---|---|---|
| | Volume median particle size ($D_{50}$) (μm) | CV value | Volume median particle size ($D_{50}$) (μm) | CV value | Water content (wt %) |
| Example 9 | 9.6 | 25 | 8.6 | 24 | 0.4 |
| Example 10 | 8.4 | 25 | 8.5 | 23 | 0.3 |
| Example 11 | 8.5 | 25 | 8.5 | 24 | 0.3 |
| Example 12 | 8.4 | 25 | 8.3 | 24 | 0.4 |
| Comparative Example 8 | 12.7 | 29 | 13.8 | 48 | 0.3 |

| | Toner | | | |
|---|---|---|---|---|
| | Cyan toner | Volume median particle size ($D_{50}$) (μm) | CV value | Glass transition point (° C.) |
| Example 9 | 1 | 6.2 | 24 | 53 |
| Example 10 | 2 | 6.0 | 24 | 54 |
| Example 11 | 3 | 6.0 | 23 | 52 |
| Example 12 | 4 | 5.9 | 25 | 50 |
| Comparative Example 8 | 5 | 10.1 | 35 | 49 |

TABLE 2-continued

| | Toner | | |
|---|---|---|---|
| | Formation of wax composite | Low-temperature fixing property:minimum fixing temperature (° C.) | Durability (number of streaks or scores formed) |
| Example 9 | Composite formed | 140 | 2 |
| Example 10 | Composite formed | 140 | 1 |
| Example 11 | Composite formed | 130 | 4 |
| Example 12 | Composite formed | 130 | 5 |
| Comparative Example 8 | No composite formed | — | — |

What is claimed is:

1. A process for producing a toner for electrophotography comprising:

(A) dispersing a releasing agent in an aqueous medium in the presence of a dibasic acid containing at least one substitutent selected from the group consisting of an alkyl group and an alkenyl group, wherein the dibasic acid contains at least one acid group that is a carboxyl group, or in the presence of a salt of the dibasic acid; while heating at a temperature not lower than a melting point of the releasing agent thereby producing a releasing agent dispersion;

(B) aggregating releasing agent particles and resin particles contained in the dispersion produced by mixing or contacting the releasing agent dispersion produced in the preceding step with a resin dispersion; and (C) unifying the aggregated particles obtained in the step (B).

2. The process of claim 1, wherein the dibasic acid in (A) is a dicarboxylic acid containing at least one substituent selected from the group consisting of an alkyl group and an alkenyl group each having 8 to 22 carbon atoms.

3. The process of claim 1, wherein the releasing agent contains a carbonyl group-containing compound.

4. The process of claim 1, wherein the releasing agent dispersion contains a carbonyl group-containing compound selected from the group consisting of those compounds represented by general formula (I):

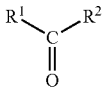

(1)

wherein $R^1$ is an aliphatic hydrocarbon group or an aromatic hydrocarbon group; and $R^2$ is an aliphatic hydrocarbon group, and aromatic hydrocarbon group or an alkoxy group, with the provision that a total number of carbon atoms contained in $R^1$ and $R^2$ ranges from 20 to 90.

5. The process of claim 1, wherein a weight ratio of the dibasic acid and the salt thereof to the releasing agent (total weight of the dibasic acid and the salt thereof/weight of the releasing agent) ranges from 0.5/100 to 10/100.

6. The process for producing a toner for electrophotography according to claim 1, wherein the dibasic acid containing at least one selected from the group consisting of an alkyl group and an alkenyl group at least one acid group of which is a carboxyl group, or a salt of the dibasic acid is dipotassium alkenylsuccinates having 12 to 20 carbon atoms.

7. The process for producing a toner for electrophotography according to claim 1, wherein the alkenyl group of dipotassium alkenylsuccinates is a mixture of a hexadecenyl group and an octadecenyl group.

8. The process for producing a toner for electrophotography according to claim 1, wherein the releasing agent is a carnauba wax and/or an ester wax.

9. The process for producing a toner for electrophotography according to claim 1, wherein the resin particles comprise a resin binder containing a polyester in an amount of 80 to 100% by weight.

10. The process for producing a toner for electrophotography according to claim 9, wherein the polyester contains polyester (a) having a softening point of 70 to 115° C. and polyester (b) having a softening point of 115 to 165° C.

11. The process for producing a toner for electrophotography according to claim 10, wherein the weight ratio of the polyester (a) to the polyester (b) (a/b) in the resin binder is from 10/90 to 90/10.

12. The process for producing a toner for electrophotography according to claim 1, wherein the resin particles contain a colorant.

13. The process for producing a toner for electrophotography according to claim 12, wherein the content of the colorant in the resin dispersion ranges from 0.01 to 20 parts by weight on the basis of 100 parts by weight of the resin binder.

14. A toner for electrophotography produced by the process of claim 1.

15. The process of claim 1, wherein the releasing agent has a melting point ranging from 50° C. to 100° C.

16. A process for producing a toner for electrophotography comprising the steps of:

(A) aggregating releasing agent particles and resin particles contained in a dispersion produced by mixing or contacting a releasing agent dispersion with a resin dispersion; and (B) unifying the aggregated particles obtained in step (A), said releasing agent and a dibasic acid containing at least one substituent selected from the group consisting of an alkyl group and an alkenyl group, or a salt of the dibasic acid, wherein at least one acid group of the dibasic acid is a carboxyl group.

17. The process of claim 16, wherein the dibasic acid is a dicarboxylic acid containing at least one substituent selected from the group consisting of an alkyl group and an alkenyl group each having 8 to 22 carbon atoms.

18. The process of claim 16, wherein the releasing agent dispersion contains a carbonyl group-containing compound.

19. The process of claim 16, wherein the releasing agent dispersion contains a carbonyl group-containing compound selected from the group consisting of those compounds represented by general formula (I):

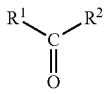

(1)

wherein $R^1$ is an aliphatic hydrocarbon group or an aromatic hydrocarbon group; and $R^2$ is an aliphatic hydrocarbon group, and aromatic hydrocarbon group or an alkoxy group, with the provision that a total number of carbon atoms contained in $R^1$ and $R^2$ ranges from 20 to 90.

20. The process of claim 16, wherein a weight ratio of the dibasic acid and the salt thereof to the releasing agent (total weight of the dibasic acid and the salt thereof/weight of the releasing agent) ranges from 0.5/100 to 10/100.

21. The process for producing a toner for electrophotography according to claim 16, wherein the dibasic acid containing at least one selected from the group consisting of an alkyl group and an alkenyl group at least one acid group of which is a carboxyl group, or a salt of the dibasic acid is dipotassium alkenylsuccinates having 12 to 20 carbon atoms.

22. The process for producing a toner for electrophotography according to claim 16, wherein the alkenyl group of dipotassium alkenylsuccinates is a mixture of a hexadecenyl group and an octadecenyl group.

23. The process for producing a toner for electrophotography according to claim 16, wherein the releasing agent is a carnauba wax and/or an ester wax.

24. The process for producing a toner for electrophotography according to claim 16, wherein the resin particles comprise a resin binder containing a polyester in an amount of 80 to 100% by weight.

25. The process for producing a toner for electrophotography according to claim 24, wherein the polyester contains polyester (a) having a softening point of 70 to 115° C. and polyester (b) having a softening point of 115 to 165° C.

26. The process for producing a toner for electrophotography according to claim 25, wherein the weight ratio of the polyester (a) to the polyester (b) (a/b) in the resin binder is from 10/90 to 90/10.

27. The process for producing a toner for electrophotography according to claim 16, wherein the resin particles contain a colorant.

28. The process for producing a toner for electrophotography according to claim 27, wherein the content of the colorant in the resin dispersion ranges from 0.01 to 20 parts by weight on the basis of 100 parts by weight of the resin binder.

29. A toner for electrophotography produced by the process of claim 16.

30. The process of claim 16, wherein the releasing agent has a melting point ranging from 50° C. to 100° C.

* * * * *